US005999863A

United States Patent [19]

Lin

[11] Patent Number: 5,999,863

[45] Date of Patent: Dec. 7, 1999

[54] MICROCONTROLLER EMBEDDED CONTROL CIRCUIT FOR MODEL RAILROADS

[75] Inventor: Zhiping Lin, Kearny, N.J.

[73] Assignee: Model Rectifier Corporation, Edison, N.J.

[21] Appl. No.: 08/962,439

[22] Filed: Oct. 31, 1997

[51] Int. Cl.[6] ..... G06F 17/00

[52] U.S. Cl. ..... 701/19; 701/20; 701/35; 188/34; 188/124; 246/187 B

[58] Field of Search ..... 701/19, 20, 35; 318/603; 188/34, 124, 140 R, 147; 246/187 B

[56] References Cited

U.S. PATENT DOCUMENTS

| | | | |
|---|---|---|---|
| 3,964,701 | 6/1976 | Kacerek | 246/2 F |
| 3,994,237 | 11/1976 | Thomsen | 104/295 |
| 4,341,982 | 7/1982 | Lahti et al. | 318/51 |
| 4,454,454 | 6/1984 | Valentine | 318/293 |
| 4,914,431 | 4/1990 | Severson et al. | 340/825.69 |
| 5,155,427 | 10/1992 | Hori | 318/696 |
| 5,184,048 | 2/1993 | Severson et al. | 318/280 |
| 5,321,344 | 6/1994 | Ott et al. | 318/280 |
| 5,394,068 | 2/1995 | Severson et al. | 318/280 |
| 5,448,142 | 9/1995 | Severson et al. | 318/280 |

*Primary Examiner*—William A. Cuchlinski, Jr.
*Assistant Examiner*—Gertrude Arthur
*Attorney, Agent, or Firm*—Johnathan E. Grant; Grant Patent Service

[57] ABSTRACT

The present invention relates to a DC power pack integrated with a micro-controller embedded controller for setting various voltages to accommodate different trains run on a track system. Micro-controller embedded controller (MECC) contains memory for pre-stored information and variable or changing information relating to the operation of the train system and related voltage and waveform requirements. Storage of variable or changing information can be in non-volatile memory or volatile memory with battery back-up. Throttle setting, braking and acceleration are controlled with the MECC connected to a user interface for selecting a number of possible values to increase the realism of the railroad operation. The railroader is capable of setting acceleration and deceleration times. Alternate embodiments provide for uploading/downloading data and information from the present invention to update the variable information pertaining to the operation of various manufactures trains and their operation set points. A short circuit or overload sensor is provided to protect the power pack circuit.

16 Claims, 2 Drawing Sheets

MICROCONTROLLER EMBEDDED CONTROL CIRCUIT FOR MODEL RAILROADS

FIELD OF THE INVENTION

The invention generally relates to power pack regulators for model trains and railroads. Particularly, the current invention relates to a microcontroller control circuit operated voltage device that provides a means for storing information pertaining to multiple variables related to the operation of model trains and railroads and their operating voltages, times of selected options for operation and waveform generation requirements.

BACKGROUND OF THE INVENTION

Over the years, attempts have been made to control model trains and railroads with various levels of success. In many cases the system allows for only a few operations to be controlled such as the original AC trains having forward, reverse and stop for an individual train on a single track. In some cases the use of digital circuitry has been incorporated to control the relative states of these circuits and generate pulses to initiate states of operation.

The advent of DC motors made controlling the train easier and less cumbersome. However, the railroader continues to seek greater control over the operation of every aspect of the train and railroad. As DC motors have become more prevalent in the model train industry the sophistication of controllers for the locomotives has increased allowing for multiple trains of various manufactures to occupy the same or shared tracks. This has also given way to an increased desire to make the operation of the train to function as similar as possible to an actual locomotive engine wether it steam, coal or electric in nature.

When a model train operator currently uses a DC locomotive he needs a specific power pack or controller functioning within a certain range of operation specific to a DC locomotive. Unfortunately, if the operator has multiple trains by various manufacturers he is placed in a unenviable position of choosing which trains he can run with which power source on which tracks. This is very limiting and possibly even dangerous to either the train or the power pack. Further, solutions provided to railroaders have been complex in operation, not adaptable to multiple train requirements or required external computer interfaces to operate. The modern railroader still likes the simplicity of operation and yet wants the more sophisticated operation.

DESCRIPTION OF THE PRIOR ART

Locomotive control circuits are generally exemplified by systems as are presented in U.S. Pat. Nos. 5,394,068 and 5,448,142 both issued to Severson et al. and as described therein as prior art. Particularly, Severson directed to a programmable state machine directed to controlling when specific states will occur during the operation of a train. This system is not directed to accommodating different trains by dynamic programming for each individual train. Nor, does Severson address the storage of waveforms for maximizing performance for specific model of locomotives. Further, the operator programmed set values of different acceleration, deceleration momentum, maximum allowed voltage and throttle control for specific locomotives is not addressed as in the present invention.

Other examples of locomotive control systems are disclosed in the following patents: U.S. Pat. Nos. 3,994,237 (Thomsen), 3,964,701 (Kacerek) and 5,321,344 (Ott et al.). The differences between these types of devices and the instant invention will become apparent.

OBJECTS OF THE INVENTION

It is the principle object of the present invention to provide a power pack controlled with a microcontroller providing for the storage and retrieval of data relating to the operation of model trains and railroads.

Another object of the invention is to provide a power pack controlled with a microcontroller using simple data input device to enter operating parameters for model trains.

Another object of the invention is to provide a power pack controlled with a microcontroller to store waveforms related to the operating parameters for specific model trains.

Another object of the invention is to provide a power pack controlled with a microcontroller to convert throttle settings to digital command and output PWM to drive a DC locomotive.

Another object of the invention is to provide a device capable of adding a very narrow pulse to a normal output signal to overcome static friction.

Yet another object of the invention is to provide a device capable of being programmed for a maximum voltage to accommodate different gauges of model railroads and to adjust top speed closely matching the scale speed of version real locomotive.

Yet another object of the invention is to provide a device capable of being programmed for acceleration and deceleration momentum to allow different gauges of model railroads and realistic operation to match the scale operation of version real locomotive.

A further object of the invention is to provide a device to accommodate a number of different model trains and provide a realistic simulation of operation to a version real locomotive.

These and other objects of the present invention will become apparent hereinafter.

SUMMARY OF THE INVENTION

These and other objects are accomplished in accordance with the present invention wherein the device provides a microcontrolled power pack programmable to operate with a wide variety of DC trains.

Another aspect of the present invention is the ability to program and set a specific input mode and enter data via a variable data entry device. The data entered is stored in associated volatile memory related to the selected mode of opera:ion.

The data entered and stored in associated memory is processed by a microcontroller to calculate values for an output signal. The output signal is pulse width modulated signal used to control a train. Waveforms are pre-stored in numerical format in nonvolatile memory. The nonvolatile memory may be flash, battery protected volatile, ROM, EPROM or similar technologies. The waveforms in combination with the calculated results from data entered from the railroader are used to provide specific output signals and controls for trains.

A microcontroller is used in one embodiment, however, a microprocessor with external RAM and ROM, or an ASIC can be used with minor design change. Since a microcontroller includes RAM and ROM internal this was the simplest embodiment to provide. The use of simple buttons and LEDs were also shown. Using a microcontroller with integrated display and keyboard drivers can also be used with minor design changes.

In accordance with another feature, the signal transforms a fixed DC to a variable DC under control of the microcontroller. This is specific to the operation of the specific train that an operator has entered related data into the microcontroller and associated memory. A protection circuit is provided to protect the power pack and related circuitry.

BRIEF DESCRIPTION OF THE DRAWINGS

A more complete understanding of the objects of the present invention will become apparent after reading the detailed description and claims as well as taking into consideration the accompanying drawings, wherein;

DETAILED DESCRIPTION OF THE PREFERRED EMBODIMENT

Figure 1:
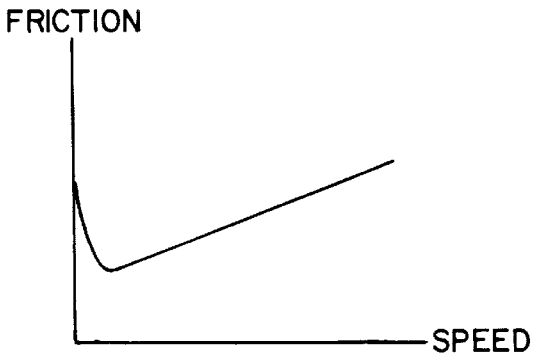
FIG. 1 is a graph showing a typical relation between friction and speed of a locomotion.
Figure 2:
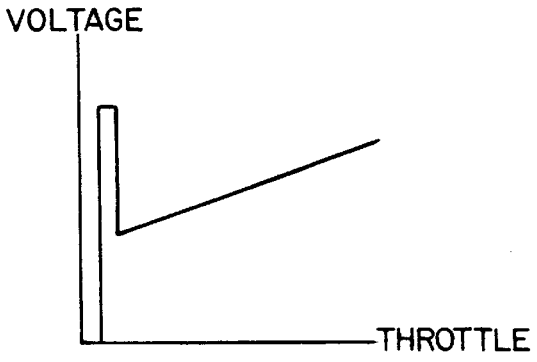
FIG. 2 is a graph showing the relation between the output voltage and the throttle setting.

Referring to FIG. 1, a shows a typical relation between friction and speed of a locomotive. It is well known that the static friction is larger than the moving friction. The present invention provides a digital control system that converts the throttle setting to digital command and outputs PWM to drive a DC locomotive. As seen in FIG. 2, the present invention adds a very narrow pulse having an amplitude twice that of the start voltage and having a duration of 50 ms to a normal output to overcome the static friction when the throttle setting is changed from zero to minimum non zero setting. This initial force, kick voltage, will make a locomotive easily start moving and maintain a very slow steady speed. A kick voltage is a narrow pulse to overcome the static friction of a locomotive. FIG. 2, shows this relationship between output voltage and throttle setting.

Different manufacturer locomotives need different start voltages to get the locomotives moving. The start voltage is a certain voltage needed to maintain a locomotive moving. The present invention therefor allows for the throttle control to be more efficient and to start the locomotive moving when the operator starts moving the throttle.

A real locomotive changes it's speed gradually. Therefor, a model locomotive should take a certain amount of time to speed up or slow down when the throttle setting is changed or the brake is applied. The present invention allows the model railroader to program this amount of time for acceleration and deceleration momentum to make their model railroading more realistic. Further, to this end, the present invention allows the railroader to program the maximum voltage to set the top speed of the model train and set this speed to match the relative speed of the real locomotion.

Figure 3:
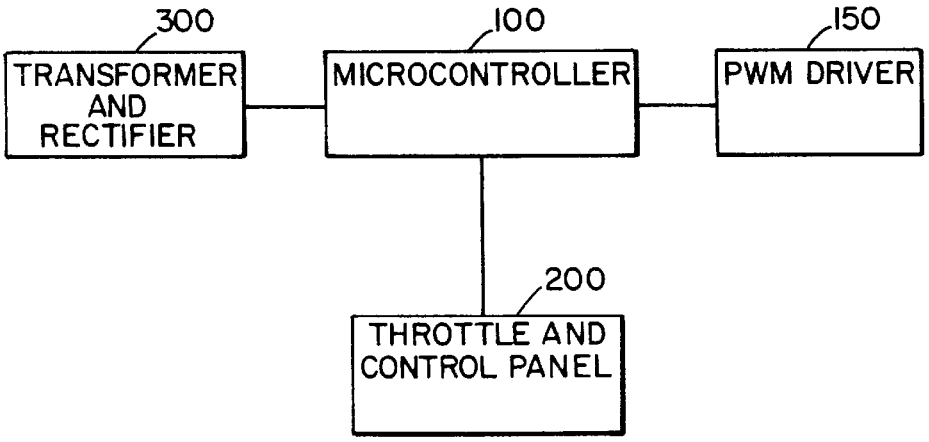
FIG. 3 is a block diagram of the present invention.

Turning now to FIG. 3, is a block diagram of the microcontroller embedded control circuit (MECC). Microcontroller 100 is interconnected with pulse width modulator (PWM) 150. The DC locomotive (not shown) is driven by this PWM 150 under control signals generated from the microcontroller 100. Program settings are provided through the throttle and control panel 200 to the microcontroller 100. The power for the railroad (not shown) is provided by transformer and rectifier 300.

Figure 4:
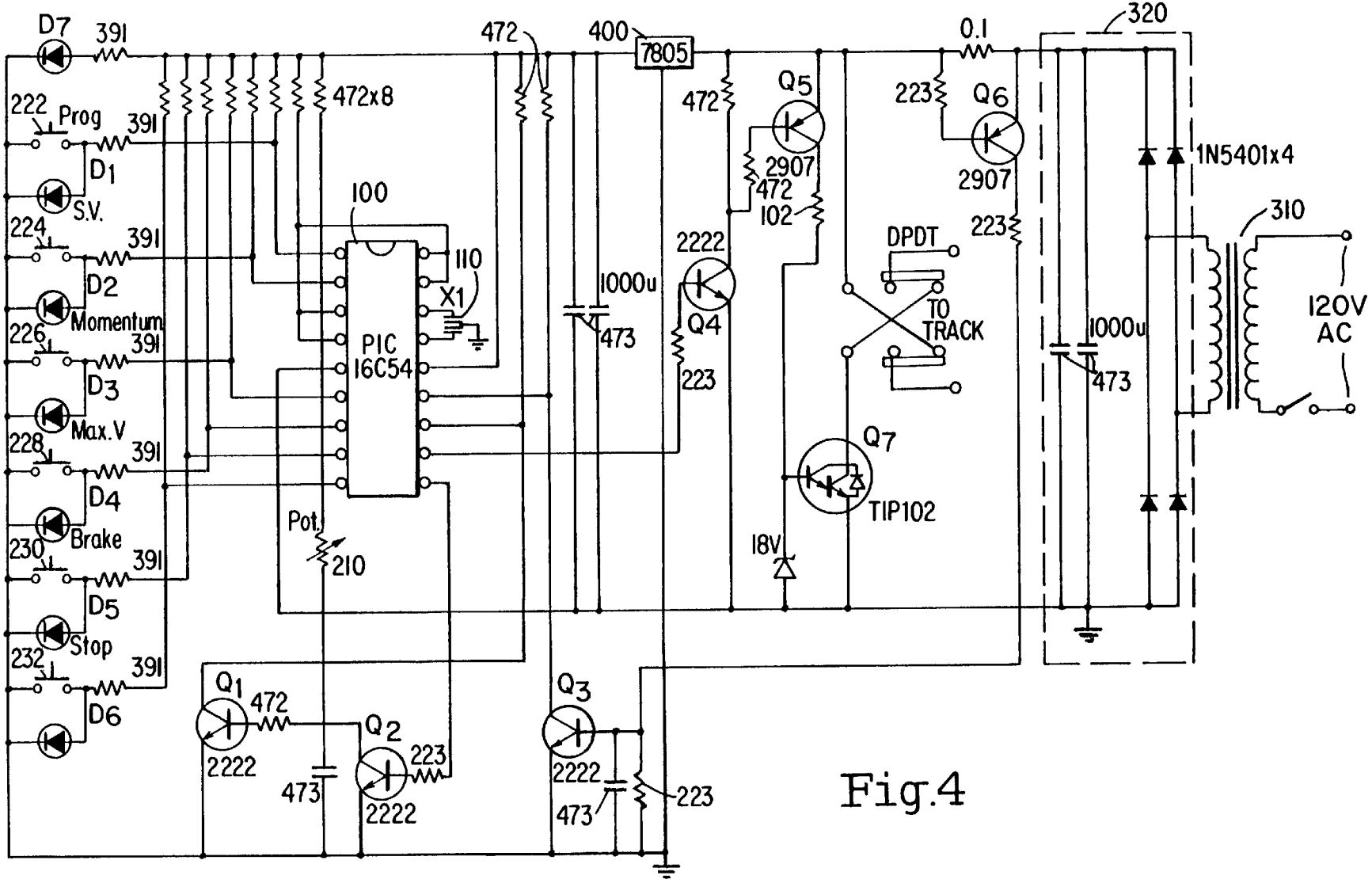
FIG. 4 is a schematic diagram of the present invention.

Referring to FIG. 4, the internal schematic construction of MECC is shown. Microprocessor 100 is interconnected to hardware as is described subsequently in this disclosure. In the present embodiment, microprocessor 100 is a microcontroller. Microcontrollers are different from straight microprocessors in a number of ways. Microcontrollers incorporate RAM, ROM and decoding circuitry that is usually implemented outside the microprocessor chip package. This provides for simpler designs, reduced parts (external) and reduced space. In the case of the present invention, these attributes allow the current invention to be compact, less expensive and easier to use. Microprocessor 100 is a PIC16C54 micro-controller embedded controller. In the alternate a KS56C220 chip made by Samsung can be used. KS56C220 is an advanced function 4-bit single chip microcontroller that integrates ROM, work RAM, I/O ports, timers, and LCD driver into one chip. Alternate designs can also be constructed using a number of other microcontrollers. The 68HC11 made by Motorola and T29 made by Toshiba, provide for similar functions. An LCD display could be chosen for in future embodiments since this chip includes the extra advantage of an onboard LCD driver. However, if a display, such as an active matrix or miniature CRT was used, the designer could use the 68HC11 or the like. Further, in embodiments in which the number of functions and the complexity of operations are increased, the use of a different microcontroller would be necessitated.

Memory is interconnect with the microcontroller or microprocessor as temporary or nonvolatile storage. Temporary storage is used to store timed event information or data from microprocessor 100. The information or data is readable and writeable from and to the temporary memory. RAM is disclosed herein as the temporary memory, however other storage devices can be implemented. In the alternative a hard drive or similar read/writeable device can be used. ROM is a read only memory, and is discussed herein as a generic term of art as the nonvolatile storage, in alternate embodiments an EPROM, PLA or FLASH can be used if located external and an alternate microcontroller or microprocessor is chosen. Nonvolatile storage contains the instructional routines and data for microprocessor 100 to function as a power pack controller for model trains and provide appropriate input and output functions.

Microprocessor 100 uses a crystal clock oscillator 110 to provide timing for functions within. Reset on the microprocessor 100 can be set to a ground state with a de-coupling capacitor and a simple switch circuit (not shown).

Selector buttons 222–232, are connected to the microprocessor 100 in a manner so as to provide a negative signal upon actuation of any one of the buttons 222–232. If any button 222–232 is actuated by an operator, a low signal will appear on the respective input line to microprocessor 100. In the alternative, a touch entry systems may include touch pads, capacitive, inductive, resistive and optical devices. A keyboard having a multiplicity of keys can also be used if functional requirements deem it necessary. The use of buttons is disclosed in the current embodiment and should not be limited to such.

LED display indicators D1–D6 are connected to microprocessor 100. This is one type of display. LEDs are shown since the current microprocessor 100 is without an integrated display driver circuit. Displays providing intelligible information, yet having a small size can also be implemented. A flat panel matrix can be used as an alternate to LEDs D1–D6. In the alternate a LCD display may be used. The main concerns regarding any indicator used in the present invention is the simplicity and effectiveness of the indicator to provide meaningful information. The information needs to be displayed in a visible manner so that the operator is aware that the unit is functioning correctly and which mode the device is in at any given time.

In FIG. 4, the circuit power is provided by voltage rectifier 400. Alternately the circuitry can be powered by two LR-44 (3.0V) or the like, alkaline button cells. Small rechargeable cells can also be used. A built in sleeping routine can be programmed into the microprocessor 100. Wake-up would be initiated by pressing Program button 222 once during the sleep cycle. Power for voltage rectifier 400 and track(not shown) is provided through transformer 310 and DC rectifier 320.

Throttle 210 is sampled by microprocessor 100 through sensing circuit shown as Q1,Q2 and related capacitor and resistors. The measured value is either stored in a memory area depending on the program mode selected by the operator or used as a real time value for operation in the run mode. Throttle 210 is a variable input device disclosed as a potentiometer, however, any analog or digital device providing a similar variable input can be used. A rotary encoder or touch sensitive pad with digital to analog circuit converter are two examples of alternate variable input devices.

Program mode selection button 222, is pressed to set microprocessor 100 into either program mode or run mode. In program mode button 222 is pressed, then the operator sets throttle 210 to a value and presses a button for the mode value to be set.

In program mode, the operator sets throttle 210 to a value then presses start voltage button 224. Microprocessor 100 then stores the value set by the operator in a specific memory location relating to start voltage for a specific train.

Maximum voltage for operation of a specific train is entered by first placing the present invention in program mode, then setting the throttle 210 to a value and then the operator presses the maximum voltage button 228. This value will be stored a specific memory location relating to maximum voltage for the train.

Acceleration and deceleration momentum is set by pressing the program button 222, setting the throttle 210 to a value and then pressing the momentum button 226. The value is stored in a specific memory location relating to momentum for a given train.

Also provided are select buttons 230 and 232 for brake and stop respectively. These are inputs to microprocessor 100 to trigger either a braking action or a stopping action to a train from microprocessor 100.

In a like manner other values may be set and stored in microprocessor 100, provided the keyboard or buttons are expanded as discussed above as an alternate embodiment. These can include braking distances, stopping distances or other desired parameters for operating a model train or railroad. Moreover, the use of an LED for each program mode can be replaced with segmented display as discussed above as an alternate embodiment.

Microprocessor 100 takes the sampled throttle settings stored in memory and calculates the real DC output voltage according to the start voltage value and acceleration and deceleration momentum value. The appropriate pulse width modulated signal is calculated from a stored list or table of waveforms and outputted to power amplifier Q4,Q5. The signal is then provided through Q7 and DPDT1 to a train track. These stages transform the fixed DC, proved from transformer 310 and rectifier 320 into variable DC power to power a model train. Further, a short circuit or overload sensor circuit is provided to protect the power pack and related controller circuit.

In the run mode, the actual speed of a locomotive is not necessary to equal the throttle setting because there may be momentum that has already been programmed into the system. The initial kick voltage is added to the output voltage when the output voltage is changed from zero voltage to a minimum non zero voltage. The microprocessor is therefor compensating for static friction with values stored in memory and preset values previously stored within a separate area of memory. The multiplier factor and time duration for pulsing the kick voltage can be set in memory having either a fixed single value or a look up table value. Further, reprogramming values based upon different train manufactures may be accomplished through programming simple routines to allow the values to be entered through buttons 224–232 and/or throttle 210.

Various modes of carrying out the invention are contemplated as being within the scope of the following claims particularly pointing out and distinctly claiming the subject matter which is regarded as the invention. Further, while the invention has been described in terms of several embodiments, it is contemplated that it may be practiced with modifications within the spirit and scope of the appended claims.

I claim:

1. A programmable power pack apparatus, comprising:

a microprocessor connected to a temporary storage device and a nonvolatile storage device, said temporary storage device provided to store data from a first and second operator actuated data entry device and to store data resultants from program operations performed with said microprocessor and said nonvolatile storage device provided with said program operations for said microprocessor to provide controlled power to a train track;

said first data entry device connected to said microprocessor providing mode selection;

a display connected to said microprocessor providing information associated with individual mode selections;

said mode selections are associated with parameters for specific trains;

said first data entry device having a mode selection input, whereby said operator actuation of said mode selection input steps sets said microprocessor into specific modes of operation and storage;

said second data entry device having a variable input, whereby said operator actuation of said variable input sets values within said microprocessor and said temporary memory; and said mode selection inputs are selectable between operating requirement conditions for said microprocessor interconnected with said temporary and nonvolatile memory and said first and second data entry device, and said program in operation with said microprocessor to accept data from said second data entry device and output from said microprocessor a signal calculated from input from said second data entry device and data stored in said temporary and nonvolatile memory.

2. The apparatus of claim 1 wherein said microprocessor is a microcontroller.

3. The apparatus of claim 2 wherein said microcontroller is a microcontroller embedded control device.

4. The apparatus of claim 1 wherein said display is capable of providing information associated with a mode selection.

5. The apparatus of claim 4 wherein said display is formed of LEDs.

6. The apparatus of claim 1 wherein said first data entry device is an operator operable input for setting specific modes of operation with a touch sensitive device.

7. The apparatus of claim 1 wherein said second data entry device is a throttle input.

8. The apparatus of claim 1 wherein said microprocessor is an ASIC.

9. The apparatus of claim 1 wherein said temporary storage device is read/writeable memory and said nonvolatile storage device is read only memory or erasable read only memory or flash memory.

10. The apparatus of claim 1 wherein said signal is a pulse width modulated signal coupled into an amplifier.

11. The apparatus of claim 10 wherein said amplifier is coupled to a train track.

12. The apparatus of claim 1 wherein said nonvolatile storage device contains at least one waveform.

13. A method of operation for a programmable power pack for model trains comprising:

setting a microprocessor into a program mode; selecting a specific mode of operation with a first data entry device; providing data from a second data entry device to said microprocessor and associated volatile memory;

retrieving a preprogrammed value stored in non-volatile memory representing waveforms;

processing said data from said second data entry device stored in said associated volatile memory and other data stored in either said associated volatile memory or said non-volatile memory and providing an output pulse width modulated signal based on specific requirements of a specific train entered and said retrieved preprogrammed value; and feeding said signal into an amplifier for converting a fixed DC source into a variable DC source for operation of a said specific train.

14. The method of claim 13 whereby said other data is provided to said microprocessor for processing values to calculate characteristics for said output pulse width modulated signal.

15. The method of claim 14 whereby said values are generated from either data inputted through said second data entry device or said preprogrammed set of values within said non-volatile memory.

16. The method of claim 15 whereby said preprogrammed set of values are provided as waveforms in numerical form.

* * * * *